United States Patent [19]

Uchikune et al.

[11] 4,329,673

[45] May 11, 1982

[54] SWITCHABLE PERMANENT MAGNET HOLDING DEVICE

[75] Inventors: Mamoru Uchikune; Kiyoshi Yanagisawa; Mutsukazu Tagami, all of Ueda; Taketo Shimizu, Nagano; Kunio Horiuchi; Hiroo Sakaguchi, both of Ueda, all of Japan

[73] Assignee: Kanetsu Kogyo Kabushiki Kaisha, Ueda, Japan

[21] Appl. No.: 172,233

[22] Filed: Jul. 25, 1980

[30] Foreign Application Priority Data

Aug. 12, 1979 [JP] Japan ..... 54-102421

[51] Int. Cl.[3] ..... H01F 7/20

[52] U.S. Cl. ..... 335/288; 335/302

[58] Field of Search ..... 335/285, 288, 295, 302

[56] References Cited

U.S. PATENT DOCUMENTS 2,972,485 2/1961 Ferchland ..... 335/288 X 4,055,824 10/1977 Baermann ..... 335/288

*Primary Examiner*—George Harris

*Attorney, Agent, or Firm*—Stephen F. K. Yee

[57] ABSTRACT

A switchable permanent magnet holding device in which a permanent magnet rotatably disposed within a bore in a magnetic circuit block is rotated, so that the magnetism acting surfaces of the magnetic circuit block are brought into an exciting state for retaining a magnetic substance thereon and into a non-exciting state for releasing the magnetic substance therefrom. The permanent magnet is pressed against a stopper for impeding rotation thereof, due to a gyromagnetic force acting across the permanent magnet and the magnetic circuit block when the permanent magnet is rotated to a position in which the magnetism acting surfaces of the block become exciting.

5 Claims, 4 Drawing Figures

SWITCHABLE PERMANENT MAGNET HOLDING DEVICE

BACKGROUND OF THE INVENTION

1. Field of the Invention

This invention relates to a switchable permanent magnet holding device for holding or being held by a magnetic substance.

2. Description of the Prior Art

One of the conventional permanent magnet holding devices of the type, as generally shown at 10 in FIG. 1, includes a magnetic circuit block 16 consisting of a pair of magnetic pole members 12 and a non-magnetic plate 14 disposed between the pair of magnetic pole members, and a columnar permanent magnet 18 rotatably disposed within a bore running through the magnetic block.

The permanent magnet 18 is magnetized in the diametrical direction thereof. When the permanent magnet 18 assumes a rotating position in which the direction of magnetization of the magnet runs in parallel to the non-magnetic plate 14, as shown in FIG. 1, then respective magnetic flux $\phi$ forms a close loop within the magnetic circuit block 16, without running across a magnetism acting surface 20 of respective magnetic pole member 12. Accordingly, the magnetism acting surfaces 20 remain non-exciting, when the permanent magnet 18 assumes that position, and hence the permanent magnet holding device 10 remains non-exciting.

When the permanent magnet 18 is turned, for example, counterclockwise substantially through 90° from the non-exciting rotating position, the magnetism acting surfaces 20 become excited.

So far as the permanent magnet 18 assumes the non-exciting rotating position or the excited rotating position making a right angle with respect to the non-exciting rotating position, since the magnetic circuit block 16 is held in magnetical equilibrium, the permanent magnet 18 by no means receives a gyromagnetic force.

When the permanent magnet 18 assumes an intermediate position between the exciting rotating position and the non-exciting rotating position, as shown in FIG. 2, the magnetic equilibrium of the magnetic circuit block 16 is broken, and the permanent magnet 18 receives a gyromagnetic force. In the graph of FIG. 2, the axis of abscissa represents an angle of rotation ($\theta$) of the permanent magnet 18 from the non-exciting rotating position shown in FIG. 1, and the axis of the ordinate represents a gyromagnetic force T which the permanent magnet 18 receives. The graph represents a variation in a gyromagnetic force which occurs when a magnetic substance is abutted on the magnetism acting surfaces of the block 16. From this graph, it is seen that when the permanent magnet 18 is located at an exciting rotating position which makes a right angle with respect to the first non-exciting position, the permanent magnet 18 by no means receives a gyromagnetic force toward the first non-exciting rotating position located at a zero degree or the second non-exciting rotating position located at 180° which is opposite thereto. By displacement to some degree of the permanent magnet 18 from the exciting rotating position located at 90° in rotational angle, the permanent magnet 18 receives a strong gyromagnetic force toward the non-exciting rotating position located at a zero degree or that located at 180° to which the permanent magnet 18 has been displaced.

Because of such a structure, a problem has been encountered with the conventional permanent magnet holding device, in which when the permanent magnet holding device 10 receives shock, the permanent magnet 18 located at the excited rotating position is displaced therefrom to some degree and turned toward one of the non-exciting rotating positions due to the gyromagnetic force, as a result of which the permanent magnet holding device becomes unexpectedly non-exciting thus leading to an accident.

Such trend has been marked, particularly with a permanent magnet holding device of the type, in which, with a view to reducing a working force for rotating the permanent magnet 18, the sliding surfaces of the permanent magnet 18 relative to the magnetic circuit block 16 make smooth so as to decrease the mechanical frictional force therebetween. In such a device, the permanent magnet 18 is easily displaced from the exciting rotating position even by a feeble external force such as oscillation, as a result of which the holding device becomes suddenly non-exciting.

SUMMARY OF THE INVENTION

It is an object of the present invention to provide a switchable permanent magnet holding device, wherein the permanent magnet holding device remains excited, irrespective of an external force, such as vibration or shock exerted thereon.

The present invention is characterized in that, in view of the fact that when a permanent magnet rotatably disposed within a magnetic circuit block is rotated in one direction to a position over 90° from a first non-exciting rotating position, then the permanent magnet receives a gyromagnetic force directed to a second non-exciting rotating position making 180° with respect to the first non-exciting rotating position; there is provided a stopper in the magnetic circuit block, so as to self-retain the permanent magnet in the exciting rotating position due to the gyromagnetic force.

According to the present invention, there is provided a switchable permanent magnet holding device which comprises; a magnetic circuit block consisting of a pair of magnetic pole members respectively having a magnetism acting surface and a non-magnetic plate disposed between the pair of magnetic pole members, and provided with a bore running in parallel to the non-magnetic plate and having a circular cross section; a permanent magnet disposed within the bore rotatably about the central axis of the bore and adapted to be turned so as to make respective magnetism acting surface non-exciting or exciting; and a stopper for impeding rotation of the permanent magnet, the stopper being adapted to engage the permanent magnet rotated to a position over a predetermined rotational angle at which the magnetism acting surfaces of the block become exciting and the magnetic circuit block is maintained in a state of magnetical equilibrium, when the permanent magnet is turned in one direction, in order to switch the non-exciting state of the magnetism acting surfaces of the block to the exciting state.

DESCRIPTION OF THE PREFERRED EMBODIMENTS

Figure 1:
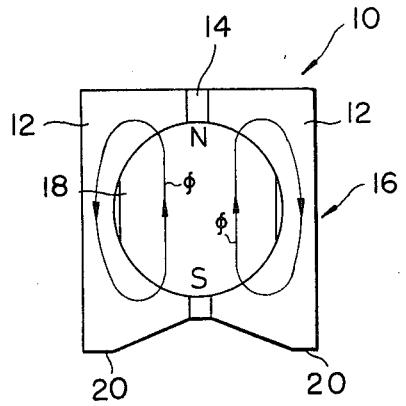
FIG. 1 PRIOR ART
FIG. 1 is an explanatory side view of a conventional permanent magnet holding device.

A permanent magnet holding device 30 according to the present invention comprises; a magnetic circuit block 36 including a pair of magnetic pole members 32 and a non-magnetic plate 34 disposed between the pair of magnetic pole members 32 and coupled integrally therewith; and a permanent magnet 38.

The magnetic circuit block 36 is provided with a bore 40 for receiving therein the permanent magnet 38, likewise in the prior art device. The bore 40 has a circular cross section and opens from one end of the magnetic circuit block 36, to run in parallel to the non-magnetic plate 34, as if spliting same longitudinally. Respective magnetic pole member 32 has a flat magnetism acting surface 42 similar to those of the conventional device, for magnetically attracting thereto a magnetic substance (not shown).

The permanent magnet 38 is a cylindrical permanent magnet on the whole and magnetized in a diametrical direction thereof. The diametrically opposite circumferential portions of the permanent magnet 18 which are positioned in a direction of making a right angle with respect to the direction of magnetization are bevelled to thereby form flat surfaces 44, respectively. A diametrically extending ridge 46 is provided on one end face of the permanent magnet 38 in alignment with the direction of magnetization.

The permanent magnet 38 is fitted into the bore, with the ridge 46 facing the open end of block 36, so that the permanent magnet 38 is rotatable about the central axis of the bore 40. An operation knob 48 for manipulating the permanent magnet 38 is fitted on the end of the ridge portion 46.

The position shown in FIG. 3, of the permanent magnet 38 is a first non-exciting rotation position, in which the direction of magnetization of the permanent magnet 38 is in parallel to the non-magnetic plate 34 and the magnetism acting surfaces 42 are maintained non-exciting, as described with reference to the conventional device in FIG. 1. When the operation knob 48 is turned counterclockwise as viewed from the side of the knob 48, then the permanent magnet 38 rotated integrally with the operation knob 48 receives a gyromagnetic force as large as that shown in FIG. 2 according to an angle of rotation from the first non-exciting rotating position.

With a view to regulating an angle of rotation of the permanent magnet 38, a through-hole 50 runs in one magnetic pole member 32 to open to the bore 40. A pin 52 is inserted into the through-hole 50. The pin 52 is secured to the aforesaid one magnetic pole member 32, with the tip projecting into the bore 40 engageably with one side surface of the ridge 46.

Figure 4:
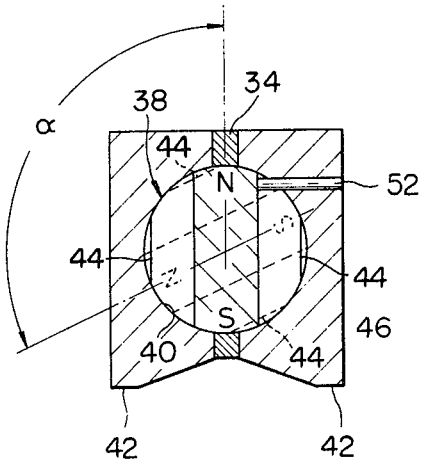

The tip of the pin 52 which projects from the through-hole engages one side wall of the ridge 46 of the permanent magnet 38 when positioned in the non-exciting rotation position, as best seen in FIG. 4, thereby impeding clockwise movement of the permanent magnet 38. When the operation knob 48 is turned counterclockwise, the flank of the tip portion of the pin 52 which projects from the through-hole engages the aforesaid one side wall of the ridge 46, thereby impeding rotation over an angle $\alpha$, of the permanent magnet 38.

Figure 2:
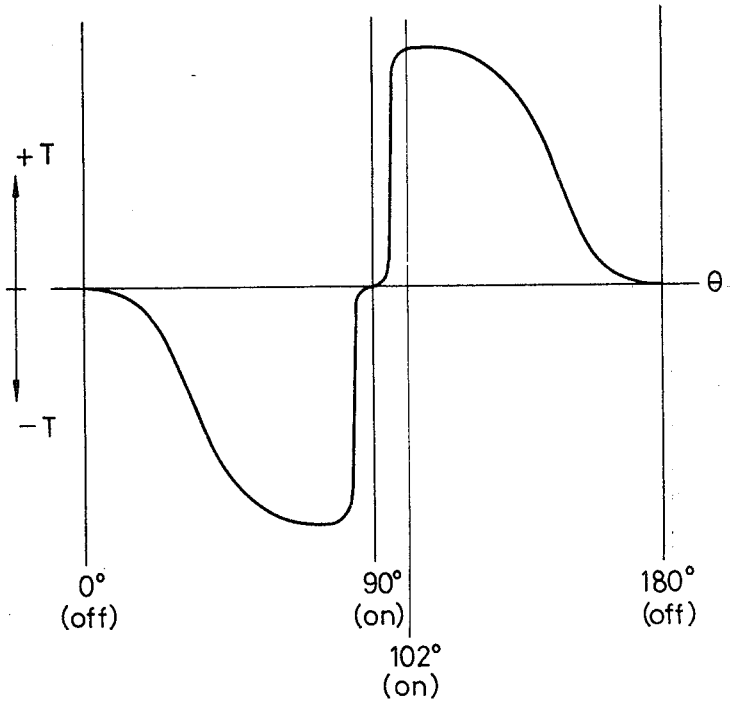
FIG. 2 is a graph representing a rotational characteristic of a permanent magnet holding device according to the present invention.
Figure 3:
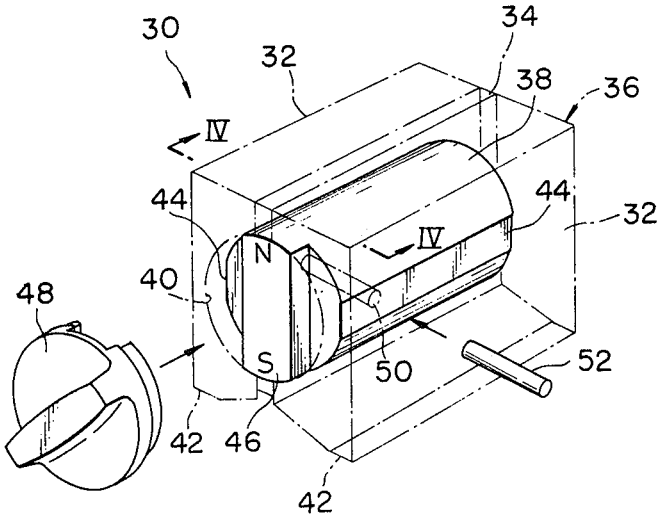
FIG. 3 is an exploded perspective view of a permanent magnet holding device according to the present invention; and, FIG. 4 is a cross sectional view taken along the line IV—IV of FIG. 3.

The angle $\alpha$ to be regulated by the stopper 52 is determined to be in the range of larger than but approximate to 90° and of causing a large gyromagnetic force, as shown in FIG. 2, for example, being determined at 102°.

In the permanent magnet holding device 30 relating to the present invention, when the permanent magnet 38 is turned counterclockwise by the operation knob 48, a gyromagnetic force against rotation of the permanent magnet, namely, the negative gyromagnetic force, acts on the permanent magnet 38, as shown in FIG. 2, likewise in the conventional device, until the permanent magnet 38 is rotated through 90°. When the permanent magnet 38 is rotated over 90° against the gyromagnetic force, the positive gyromagnetic force for complementing rotation of the permanent magnet 38, as shown in FIG. 2, acts on the permanent magnet. Owing to the positive gyromagnetic force, the permanent magnet 38 tends to further move counterclockwise. However, this trend is impeded because rotation of the permanent magnet 38 is limited to the angle $\alpha$ by the stopper, and hence, the permanent magnet 38 is locked at the angle $\alpha$ as shown by a broken line in FIG. 4.

The angle $\alpha$ at which the permanent magnet 38 is locked is a position deviated to some degree from the proper exciting rotating position (90°). The magnetic flux of the permanent magnet 38 generates across respective magnetism acting surface 42, to thereby excite respective magnetism acting surface 42, whereby the permanent magnet holding device 30 retains a magnetic force as strong as that in the conventional device. Furthermore, since the aforesaid positive gyromagnetic force acts on the permanent magnet 38 as a biasing force toward the stopper when positioned at the angle $\alpha$, the permanent magnet 38 positioned at the angle $\alpha$ has no likelihood of being unexpectedly rotated to the non-exciting position due to an external force such as vibration, and hence unexpected demagnetization of the permanent magnet holding device 30 is avoided.

If the operation knob 48 is turned clockwise against the aforesaid positive gyromagnetic force, the permanent magnet holding device 30 becomes non-exciting, so as to return the permanent magnet 38 to the first non-exciting position.

In the above embodiment, a solid columnar permanent magnet is used. As an alternative, a magnet assembly having a pair of pole pieces may be used. The stopper for regulating rotation of the permanent magnet may be a member integrally formed of the magnetic pole member and projecting into the bore, instead of the pin used in the above embodiment.

According to the present invention, the permanent magnet receives the gyromagnetic force toward the stopper for permanent magnet, when the former is positioned at the exciting rotating position in which the magnetism acting surfaces of the magnetic circuit block is rendered exciting whereas the permanent magnet can be retained in the excited rotating position, without a risk of being unexpectedly demagnetized.

What is claimed is:

1. A switchable permanent magnet holding device comprising; a magnetic circuit block consisting of a pair of magnetic pole members respectively having a magnetism acting surface, and a non-magnetic plate disposed between said pair of magnetic pole members, said magnetic circuit block being provided with a bore having a circular cross section and running in parallel to the non-magnetic plate;

a permanent magnet disposed in said bore rotatably about the central axis of said bore and adapted to be switched between a position in which said magnetism acting surfaces of said block become non-exciting and a position in which said magnetism acting surfaces thereof become exciting; and, a stopper for impeding rotation of the permanent magnet, said stopper being adapted to engage said permanent magnet rotated to a position over a predetermined angle of rotation at which said magnetism acting surfaces of said block become exciting and said magnetic circuit block is maintained in a state of magnetic equilibrium, when said permanent magnet is turned in one direction, in order to switch the non-excited state of the magnetism acting surface of said block to the exciting state.

2. A permanent magnet holding device as defined in claim 1, wherein said permanent magnet is a columnar shaped permanent magnet magnetized in the diametrical direction thereof.

3. A permanent magnet holding device as defined in claim 2, wherein rotation of said permanent magnet is stopped by a stopper at a position in which the direction of magnetization of the permanent magnet is deviated at an angle over 90° from a position parallel to the non-magnetic plates.

4. A permanent magnet holding device as defined in claim 3, wherein said permanent magnet has at one end face thereof a diametrically extending ridge on which an operation knob is to be fitted, and said stopper is a projection extending from the peripheral surface of said bore and engageable with said ridge of the permanent magnet.

5. A permanent magnet holding device as defined in claim 4, wherein said projection is a tip of a pin inserted into a through-hole provided in one of said magnetic pole members to open to said bore.

* * * * *